US006222505B1

(12) United States Patent
Endo et al.

(10) Patent No.: US 6,222,505 B1
(45) Date of Patent: Apr. 24, 2001

(54) COMPOSITE ANTENNA APPARATUS

(75) Inventors: Tsutomu Endo; Isamu Chiba; Masataka Ohtsuka; Yoshihiko Konishi; Shuji Urasaki, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/308,333

(22) PCT Filed: Dec. 3, 1997

(86) PCT No.: PCT/JP97/04427

§ 371 Date: May 19, 1999

§ 102(e) Date: May 19, 1999

(87) PCT Pub. No.: WO99/28989

PCT Pub. Date: Jun. 10, 1999

(51) Int. Cl.[7] ..... H01Q 1/36
(52) U.S. Cl. ..... 343/895; 343/821; 343/702
(58) Field of Search ..... 343/702, 821, 343/895, 901, 903, 906

(56) References Cited

U.S. PATENT DOCUMENTS

| | | | |
|---|---|---|---|
| 4,008,479 | 2/1977 | Smith | 343/895 |
| 5,255,001 | 10/1993 | Tamura et al. | 343/702 |
| 5,438,339 | 8/1995 | Itoh et al. | 343/702 |
| 5,600,341 | 2/1997 | Thill et al. | 343/895 |
| 5,784,034 * | 6/1998 | Konishi et al. | 343/895 |
| 5,859,621 * | 1/1999 | Leisten | 343/895 |
| 5,910,790 * | 6/1999 | Ohmuro et al. | 343/895 |

FOREIGN PATENT DOCUMENTS

| | | |
|---|---|---|
| 0521511 A2 | 1/1993 | (EP) . |
| 63-30006 | 2/1988 | (JP) . |
| 4134906 | 5/1992 | (JP) . |
| 8-65034 | 3/1996 | (JP) . |
| 8204420 | 8/1996 | (JP) . |
| 9-18215 | 1/1997 | (JP) . |
| 9-27710 | 1/1997 | (JP) . |
| 9107223 | 4/1997 | (JP) . |
| 9701196 | 1/1997 | (WO) . |

* cited by examiner

*Primary Examiner*—Tan Ho

(57) ABSTRACT

A composite antenna apparatus comprising a balun connected to an inner conductor at the upper end of a coaxial line 11, one end of a helical element formed by a pair of wire conductors is connected to the balun, the other end is wound symmetrically around the coaxial line using the the coaxial line as a center so as to face the balun and is connected to the outer conductor 13 at the lower end of the coaxial line. The provision of an outer conductor connecting terminal connected to the outer conductor and an inner conductor connecting terminal connected to the inner conductor at the lower end of the coaxial line, allows the formation, on the same axis, of a helical antenna fed by the coaxial line via the helical element and a monopole antenna formed by the outer conductor of the coaxial line. Thereby equivalent gain in the horizontal plane and a reduction in the occupied volume is achieved.

9 Claims, 10 Drawing Sheets

COMPOSITE ANTENNA APPARATUS

This application is the national phase under 35 U.S.C. §371 of PCT International Application No. PCT/JP97/04427 which has an International filing date of Dec. 3, 1997 which designated the United States of America.

FIELD OF THE INVENTION

The present invention relates to a composite antenna apparatus for transmitting and receiving different frequencies and which is capable of providing a plurality of mobile communication services on differing frequency bands with a single portable terminal.

DESCRIPTION OF THE PRIOR ART

In recent years, mobile communication services using various frequency bands have come into use. In order to provide a plurality of mobile communication services on a single terminal apparatus, the number of composite type antennas has increased.

Diagram 1 is a perspective diagram showing the components, in simplified form, of a kind of composite antenna apparatus known as a mobile-use 2-cycle shared double whip antenna as an example of a conventional mobile terminal antenna similar to that disclosed at the 1994 Electronic Communications Conference Autumn Session Exhibit B-73. In the diagram, reference numeral 1 represents the body of the portable terminal, 2 is a first antenna joined to the body 1 and 3 is a second antenna joined in a similar fashion.

In composite antennas for use with mobile terminals such as the mobile-use 2-cycle shared double whip type composite antenna shown in diagram 1, the first antenna 2 has a length $h_1$, about half the wavelength of the low frequency $f_1$ and the second antenna 3 has a length $h_2$ about half the wavelength of the high frequency $f_2$. In this kind of composite antenna apparatus, signals at a low frequency $f_1$ and signals at a high frequency $f_2$ are fed to the first antenna 2 and the second antenna 3 respectively.

Diagrams 2 and 3 are explanatory views showing, respectively, the vertical plane of the emission pattern, calculated according to the law of moments, of the effect of the first antenna 2 short circuiting when the second antenna is fed and of the effect of the second antenna 3 short circuiting when the first antenna 2 is fed. Although diagram 2 shows that there is little effect due to the first antenna 2 short circuiting when the second antenna 3 is fed, as can be seen from diagram 3, when the second antenna 3 short circuits after the first antenna 2 is fed, the emission pattern changes greatly from the normal dipole antenna emission pattern due to the influence of the second antenna 3.

Thus in a conventional composite antenna apparatus, since one antenna (the second antenna 3) may influence the other antenna (the first antenna 2) while the first antenna 2 is being fed with the result the that the emission pattern is changed greatly from a normal dipole antenna emission pattern, the problem arises that gain in the horizontal plane is reduced and so the antenna is unsuitable for a portable terminal used by a person communicating in a random environment in all horizontal directions.

The further problem arises that the arrangement of the two antennas 2, 3, in parallel increases the occupied volume and therefore decreases the portability of the portable terminal.

The purpose of the present invention is to solve the above mentioned problems by the provision of a composite antenna apparatus having antennas corresponding respectively to two different mobile communication services on the same axis. The respective antennas have equivalent gain in the horizontal plane as well as a reduced occupied volume.

Furthermore, it is a purpose of the present invention to provide a composite antenna apparatus which improves the portability of the portable terminal by using the movability of respective antennas constructed on the same axis so that they may be stored in the wireless body when not in use.

DISCLOSURE OF THE INVENTION

The composite antenna apparatus of the invention according to the scope of claim 1 provides for, at one end of a coaxial line, a balun, connected to an inner conductor and connected to the balun, one end of a helical element formed by a pair of line conductors. The other end of the helical element is aligned symmetrically, facing the balun, by turning it around the coaxial line using the coaxial line as a center and connected to the outer conductor at the other end of the coaxial line where the inner conductor connecting terminal joined to the inner conductor and the outer conductor connecting terminal joined to the outer conductor are located. In such a way, the composite antenna apparatus formed by the helical antenna fed by the coaxial line and the monopole antenna created by the outer conductor of the coaxial line running through its center are constructed on the same axis, thus allowing equivalent gain in the horizontal plane and a reduction in the occupied volume.

The composite antenna apparatus of the invention according to the scope of claim 2 includes, on the same axis, a monopole antenna created by the outer conductor of said coaxial line and a two-wire wound helical antenna fed by said coaxial line and constructed by a pair of helical elements and a single coaxial line. In this way, a composite antenna apparatus having equivalent gain in the horizontal plane and a reduction in the occupied volume can easily be constructed.

The composite antenna apparatus of the invention according the scope of claim 3 includes, on the same axis, a monopole antenna created by the outer conductor of the coaxial line and a four-wire wound helical antenna fed by the coaxial line. The helical antenna is formed by providing a balun and a phase delay element on one end of a single coaxial line, one end of a first helical element is connected directly to the balun and an end of a second helical element is connected to the balun through the phase delay element. In this way, it is possible to improve the symmetry of the emission pattern and provide more equivalent gain in the horizontal plane.

The composite antenna apparatus of the invention according to the scope of claim 4 includes, on the same axis, a monopole antenna created by the outer conductor of the coaxial line and a plurality of helical antennas formed by grouping a plurality of coaxial lines so that the outer conductors are in mutual contact, placing a balun at the end of each coaxial line, connecting one end of the helical element to each balun and connecting the other end of the helical element to the outer conductor at the other end of the coaxial line. In such a way, it is possible to construct, on a single axis, antennas corresponding respectively to a plurality of different kinds of services as well as providing equivalent gain in the horizontal plane and reduced occupied volume.

The composite antenna apparatus of the invention according to the scope of claim 5 includes, on a single axis, a monopole antenna created by the outer conductor of the coaxial line and two four-wire wound helical antennas formed by providing a first phase delay element and a first balun at one end of a first coaxial line and a second phase delay element and a second balun at one end of a second coaxial line, one end of the two pairs of helical elements forming the first helical antenna is connected to the first balun either directly or through the first phase delay element and one end of the two pairs of helical elements forming the second helical antenna is connected to the second balun either directly or through the second phase delay element. In such a way, it is possible to construct on a single axis antennas respectively corresponding to three different kinds of services and, due to the improvement in the symmetry of the emission pattern, to provide equivalent gain in the horizontal plane.

The composite antenna apparatus of the invention according to the scope of claim 6 provides an outer conductor connecting terminal connected to the outer conductor and an inner conductor connecting terminal connected to the inner conductor of the coaxial line placing at one end of the coaxial line mutually insulated slide-action contactors rotatable around the center of the axis of rotation orthogonal to the axis of the coaxial line. In such a way, the composite antenna apparatus, when not in use, may be piled and compacted within the wireless body, thus improving its portability.

The composite antenna apparatus of the invention according to the scope of claim 7 provides an antenna composed of helical and monopole antennas being both extendable and storable, their upper ends being electrically insulated from the coaxial line and sub-antennas being arranged in series. When in the stored position, one of the wireless circuits is connected to the connecting terminal of the sub-antenna element. When in the extended position, the wireless circuit connected to the connecting terminal of the sub-antenna element when in the stored position is connected to the outer conductor connecting terminal and the other wireless circuit is connected between the outer and inner conductor connecting terminals. In such a way, it is possible to store the composite antenna apparatus in the wireless body when not in use, thus improving its portability. When in the stored position, gain is ensured by feeding the sub-antenna element.

The composite antenna apparatus of the invention according to the scope of claim 8 uses a helical conductor made by winding a wire conductor into a helical shape as a sub-antenna element. In such a way, the sub-antenna can act as a helical monopole antenna thus ensuring gain when in the stored position.

The composite antenna apparatus of the invention according to the scope of claim 9 uses a bent conductor formed from a zigzag shaped wire conductor as a sub-antenna element.

BRIEF DESCRIPTION OF THE DRAWINGS

Diagram 1 is a perspective view showing a simplified structure of a conventional composite antenna apparatus.

Diagram 2 is an explanatory view showing the emission pattern in the vertical plane of a conventional composite antenna apparatus when the second antenna is fed and the first antenna short circuits.

Figure 1:
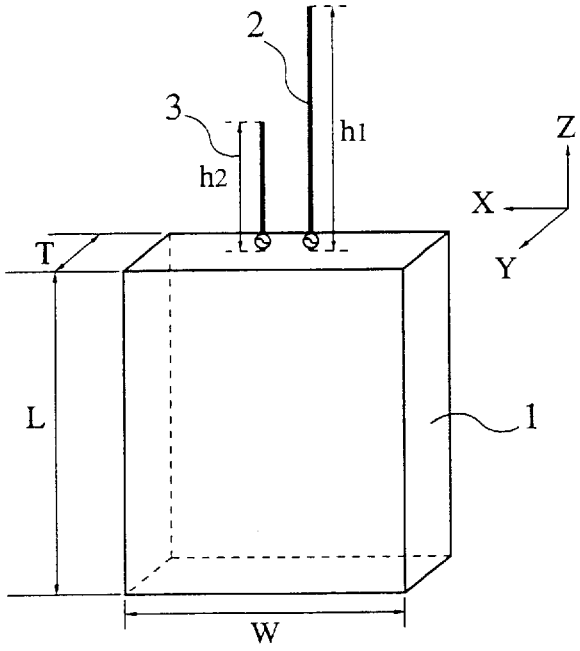
Figure 2:
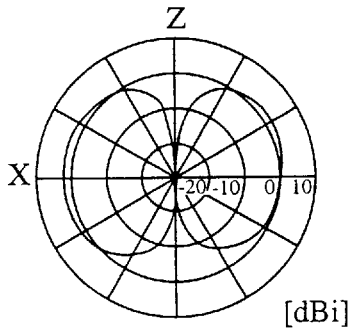
Figure 3:
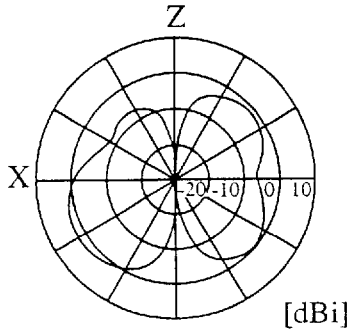

Diagram 3 is an explanatory view showing the emission pattern in the vertical plane of a conventional composite antenna apparatus when the first antenna is fed and the second antenna short circuits.

Diagram 4 is a perspective view showing the simplified structure of a composite antenna apparatus according to the first embodiment of the invention.

Diagram 5 is a perspective view showing a simplified structure of a composite antenna apparatus according to the second embodiment of the invention.

Diagram 6 is a view in plan showing schematically the connection of the central conductor of the coaxial line and the helical element in the second embodiment above.

Diagram 7 is a front elevation showing the simplified structure of a composite antenna apparatus according to the third embodiment of the invention.

Diagram 8 is a perspective view showing the simplified structure of the portable terminal used by the composite antenna apparatus in accordance with embodiment 4 of the invention.

Diagram 9 is a perspective view showing the simplified structure of the moveable fastening member of the composite antenna according to embodiment 4 of the invention.

Diagram 10 is a perspective view showing the simplified structure of the portable terminal, with antenna extended, used by the composite antenna apparatus according to embodiment 5 of the invention.

Diagram 11 is a perspective view of the simplified structure of the antenna as housed according to embodiment 5 of the invention.

Diagram 12 is a perspective view showing the simplified structure of the portable terminal, with antenna extended, used by the composite antenna apparatus according to embodiment 6 of the invention.

Diagram 13 is a perspective view showing the simplified structure of the antenna as housed according to embodiment 6 of the invention.

DETAILED DESCRIPTION OF THE PREFERRED EMBODIMENTS

In order to explain the invention in greater detail, the preferred embodiments will be set out making reference to the accompanying figures.

Embodiment 1

Diagram 4 is a perspective view showing the simplified structure of the composite antenna apparatus according to embodiment 1 of the invention and shows schematically the composite antenna apparatus used with a portable terminal as the combination, on the same axis, of a monopole antenna created by the outer conductor of the coaxial line and the helical antenna fed by said coaxial line. In the diagram, 11 is the coaxial line, 12 is the inner conductor of said coaxial line 11, similarly 13 is its outer conductor. 14 is the inner conductor connecting terminal connected to the inner conductor 12 at one end of the coaxial line 11. 15 is the outer conductor connecting terminal connected to the outer conductor 13 at the same end as the inner conductor connecting terminal 14 of the coaxial line 11.

16 is the balun which is placed at the end opposite the outer conductor connecting terminal 15 and the inner conductor connecting terminal 14 on the coaxial line 11 and is connected to the inner conductor 12 on said coaxial line 11. 17 is a helical element formed from the pair of wire conductors. One end of the helical element 17 is connected to the balun 16, the other end is symmetrically aligned facing the balun 16 by turning it around the coaxial line using the coaxial line as a center and is connected to the outer conductor 13 of the coaxial line 11 at the end to which the outer conductor connecting terminal 15 and the inner conducting connecting terminal of said coaxial line 11 are attached.

18 is a first wireless circuit connected to the outer conductor 13 of the coaxial line 11 through the outer conductor connecting terminal 15. 19 is a second wireless circuit connected respectively to the inner conductor 12 of the coaxial line 11 through the inner conductor connecting terminal 14 and to the outer conductor 13 of the coaxial line 11 through the outer conductor connecting terminal 15. The first wireless circuit 18 and second wireless circuit 19 communicate on different frequency bands. In the example in the diagram, the frequency band of the first wireless circuit 18 is lower than that of the second wireless circuit 19.

The operation of the invention will now be explained.

The helical element 17 is formed by a helical antenna fed by the coaxial line 11 to which the second wireless circuit 19 is connected through the outer conductor connecting terminal 15 and the inner conductor connecting terminal 14. Modal variation between the pair of helical elements 17 and the coaxial line 11 in the helical antenna are carried out by the balun 16 placed between the helical element 17 and the inner conductor 12 of the coaxial line 11. Since the helical antenna generates a conical beam in the direction of the axis of the coaxial line 11, equivalent gain is achieved in the same horizontal plane.

The outer conductor 13 of the coaxial line 11 to which the first wireless circuit 18 is connected through the outer conductor connecting terminal 15 functions as a monopole antenna element thus creating a nondirectional antenna in the horizontal plane.

In this way, the antenna structure displays line symmetry with respect to the coaxial line due to the fact that the helical element 17 in the helical antenna symmetrically winds around the coaxial line 11 and a monopole antenna is created by the outer conductor 13 of the coaxial line 11 acting as an antenna element.

Therefore the axes with respect to the emission pattern correspond and thus create respectively non-directional antennas in the horizontal plane.

Furthermore since such things as the conductor length and the helical pitch of the monopole antenna are independently created without the need to change the shape of the helical element 17, no change is observable in the emission pattern generated by the helical element 17.

As shown above, according to the first embodiment, since there is provided a composite antenna apparatus comprised, on the same axis, by a helical antenna created by a pair of helical elements 17 fed by the coaxial line 11 and by a monopole antenna consisting of the outer conductor 13 running through the center of the helical antenna acting as an antenna element, equivalent gain is achieved in the horizontal plane and occupied volume is decreased.

Embodiment 2.

In embodiment 1 above, a composite antenna apparatus for use with a portable terminal comprised of a two-wire wound helical antenna using a pair of helical elements and a monopole antenna created by the outer conductor of the coaxial line was explained. It is possible, however, to combine, on the same axis, four-wire wound helical antenna using two pairs of helical elements and a monopole antenna created by the outer conductor of the coaxial line.

Figure 4:
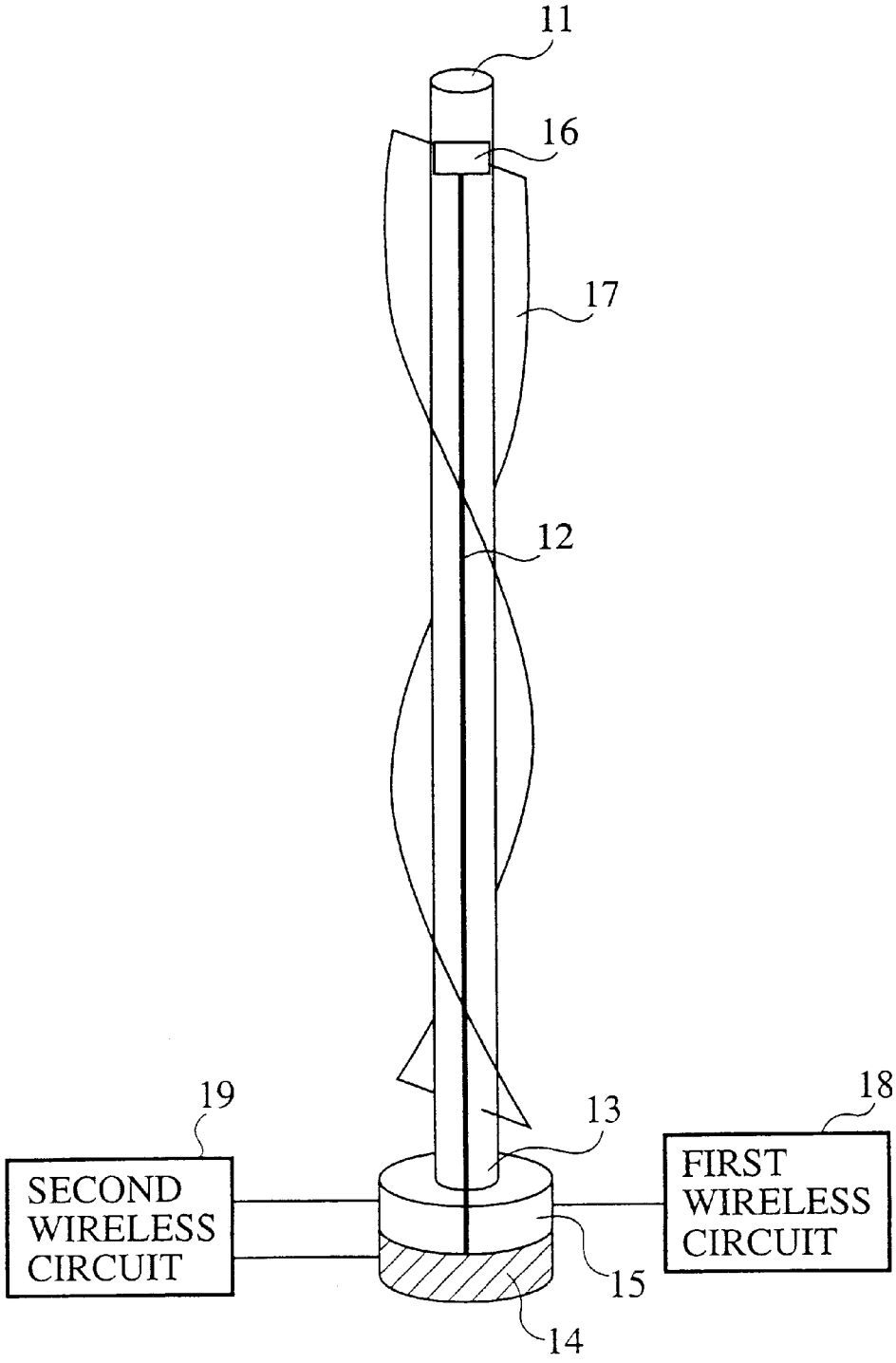

Diagram 5 is a perspective view showing the schematic structure of a composite antenna apparatus according to the second embodiment of the invention. Diagram 6 is a schematic plan view of the connection of the central conductor of the coaxial line with the helical element. In the diagram, 11 is the coaxial line, 12 is its inner conductor, 13 is its outer conductor, 14 is the inner conductor connecting terminal, 15 is the outer conductor connecting terminal, 16 is the balun, 18 is the first wireless circuit and 19 is the second wireless circuit. These are similar to those elements having like reference numerals in FIG. 4 of embodiment 1.

20 is a phase delay element placed at the end opposite to that of the outer conductor connecting terminal 15 and the inner conductor connecting terminal 14 of the coaxial line 11 and is connected to the balun 16 which is in turn connected to the inner conductor of the said coaxial line 11. 21 is the first helical element formed from a pair of wire conductors and, in a similar manner to the helical element 17 in the first embodiment, is directly connected at one end to the balun 16. 22 is the second helical element formed from a pair of wire conductors and is connected at one end to the balun 16 through the phase delay element 20. The other ends of the first helical element 21 and the second helical element 22 are aligned symmetrically facing the balun 16 and the phase delay element 20 by turning them around the coaxial line 11 using the line as a center and are connected to the outer conductor 13 of the coaxial line 11 at the end to which the inner conductor connecting terminal 14 and the outer conductor connecting terminal 15 of said coaxial line 11 are attached.

The operation of the invention will now be explained.

In the first helical member 21, the second wireless circuit 19 is fed, only via the balun 16, by the coaxial line 11 connected between the outer conductor connecting terminal 15 and the inner conductor connecting terminal 14. In the second helical element 22, the second wireless circuit 19 is fed, via the balun 16 and the phase delay element 20, by the coaxial line 11 connected between the inner conductor connecting terminal 14 and the outer conductor connecting terminal 15. In such a way, a four-wire wound helical antenna is formed. Modal variation between the coaxial line 11 and the first and second helical elements 21, 22 in the helical antenna are carried out by the balun 16. The second helical element 22 receives a fixed phase delay from the phase delay element 20 and is fed at the delayed phase by the first helical element 21. Therefore the present helical antenna generates a more symmetrical conical beam with respect to the coaxial line 11 when compared to the two wire wound helical antenna in the first embodiment.

On the other hand, the outer conductor 13 of the coaxial line 11 to which the first wireless circuit 18 is connected through the outer conductor connecting terminal 15 functions as a monopole antenna element in the same way as in the first embodiment and thus creates a non-directional antenna in the horizontal plane.

In such a way, the first and second helical elements 21, 22 of the helical antenna turn symmetrically around the coaxial line 11 and a monopole antenna is created by the outer conductor 13 of the coaxial line 11 functioning as an antenna element. Therefore the structure of the antenna displays line symmetry with respect to the coaxial line and the axes correspond as regards the emission pattern and therefore creates a non-directional antenna in the horizontal plane.

Furthermore, since such things as conductor length or helical pitch can be independently created in the monopole antenna without any change to the shape of the first helical element 21 or the second helical element 22, there is no change to the emission pattern generated by the first helical element 21 and the second helical element 22.

In such a way, according to the second embodiment, since a composite antenna apparatus is formed by the combination, on the same axis, of a four-wire wound helical antenna created by the first and second helical elements 21, 22 fed by the coaxial line 11 and by an outer conductor passing through its center and creating an antenna element acting as a monopole antenna, equivalent gain is achieved in the horizontal direction together with a reduction in the occupied volume.

Embodiment 3.

In each of the above embodiments, a composite antenna for use with a portable terminal comprising, on the same axis, a single helical antenna using a helical element fed by a coaxial line and a monopole antenna created by the outer conductor of the said coaxial line was explained. However, it is possible to combine a plurality of helical antennas with a single monopole antenna.

Figure 5:
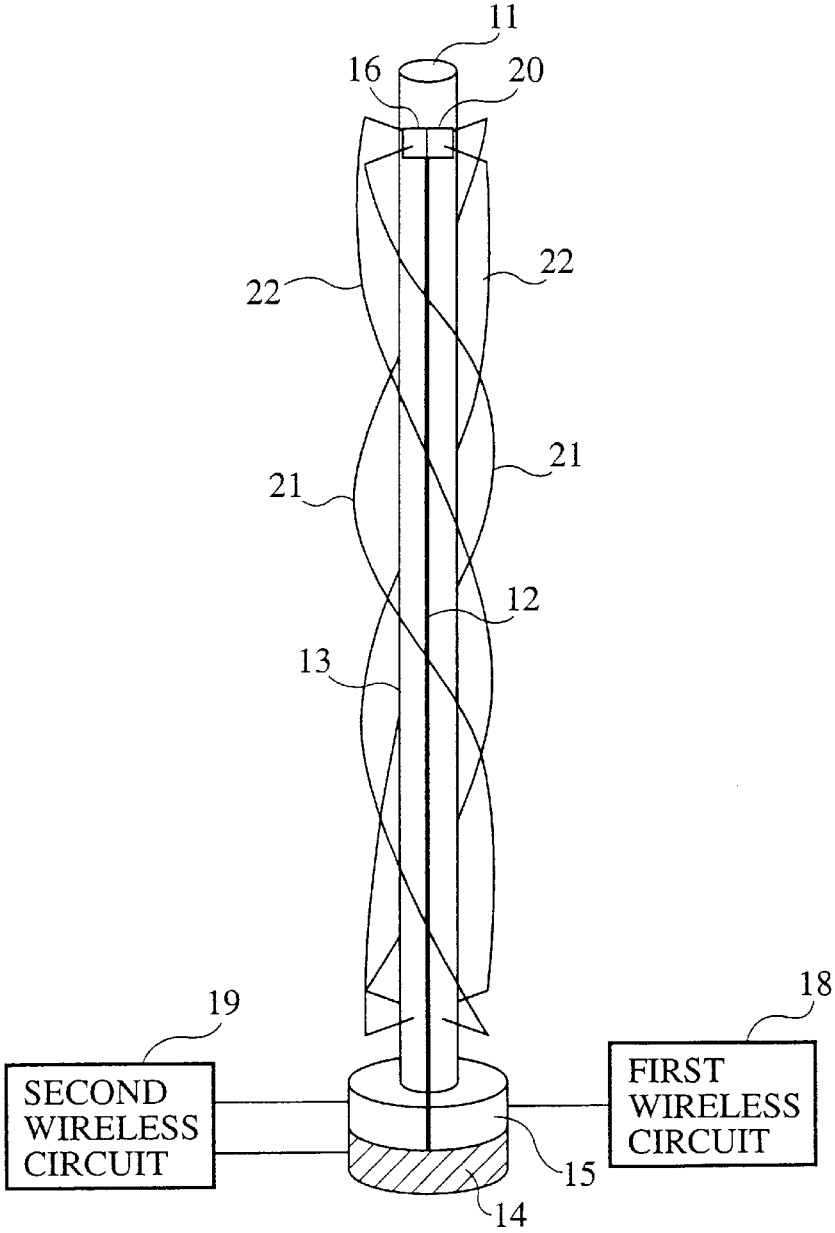
Figure 6:
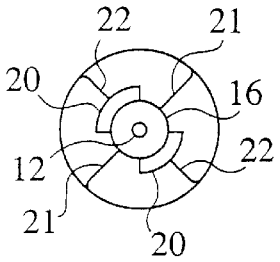
Figure 7:
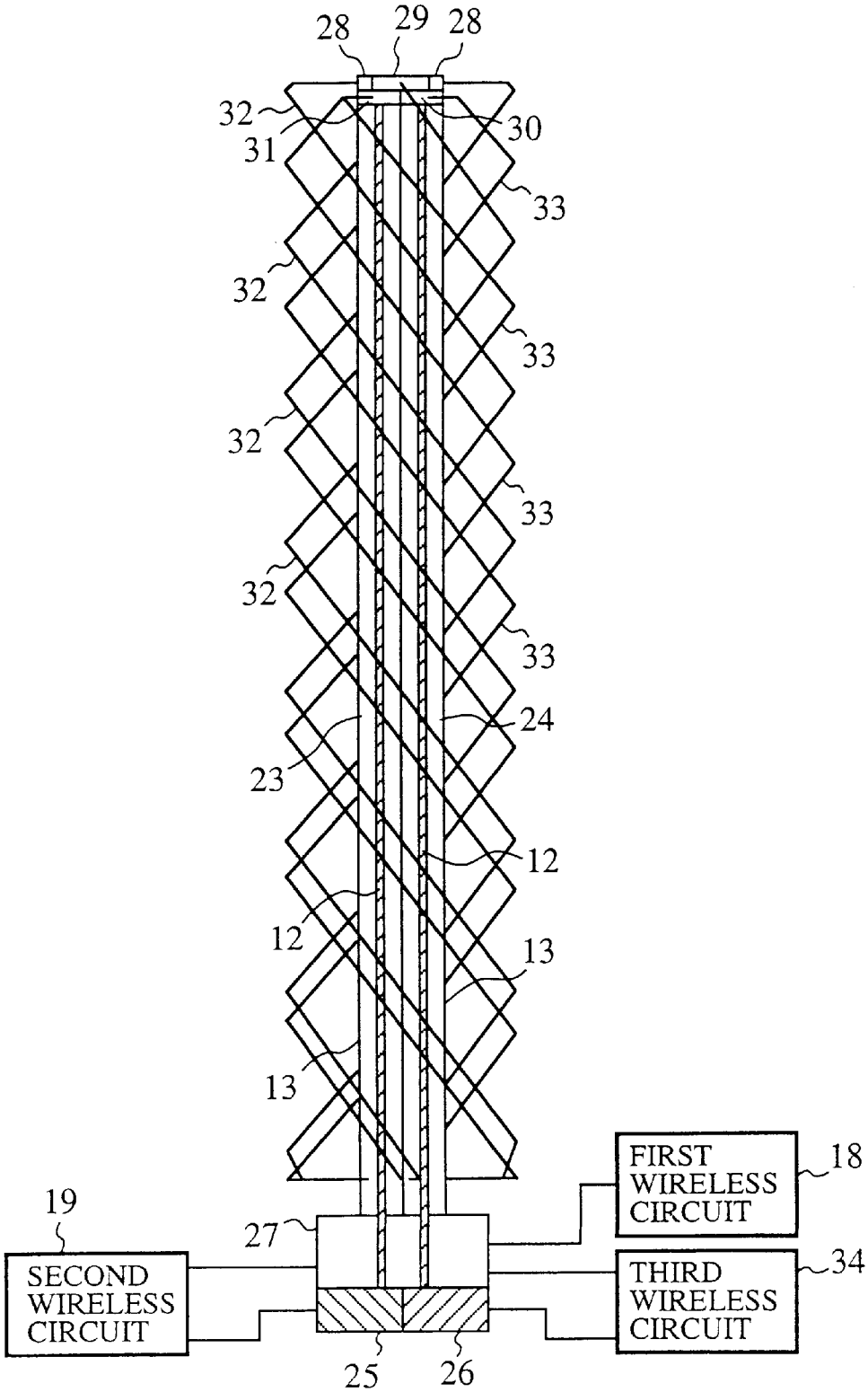
Figure 8:
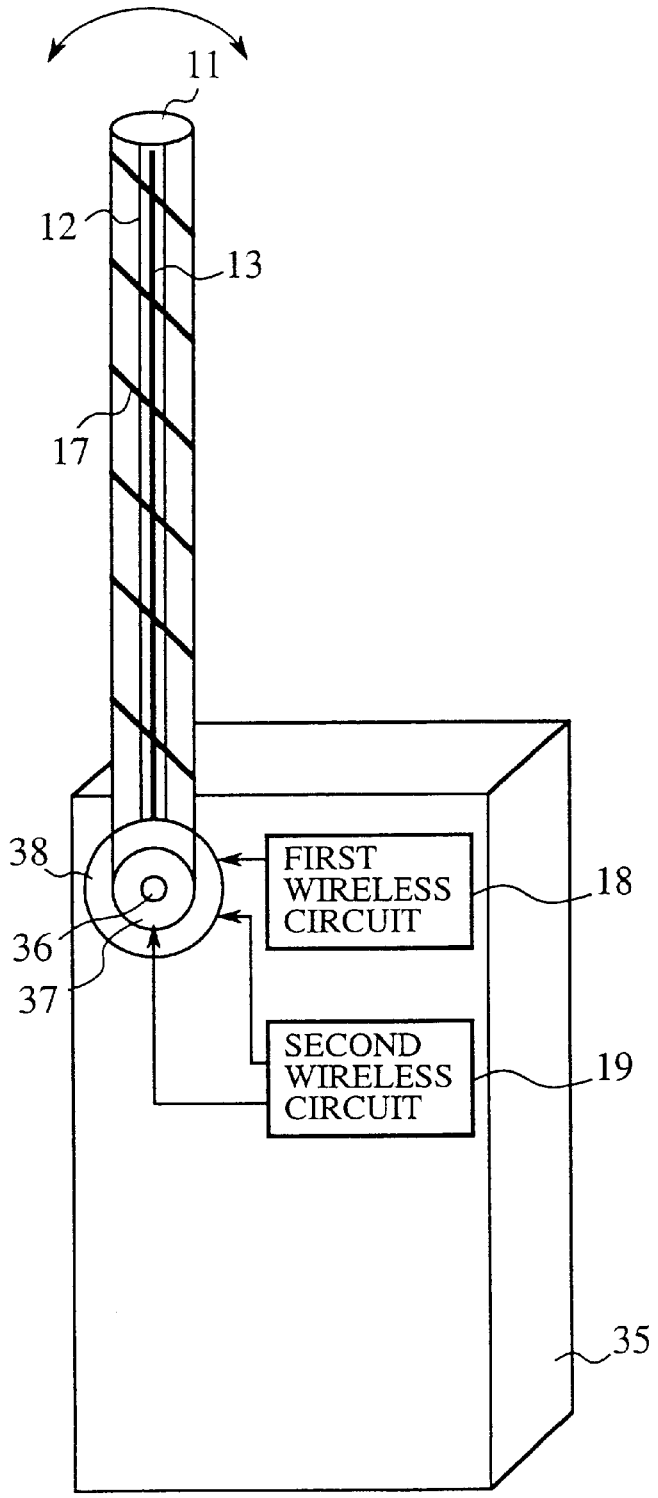
Figure 9:
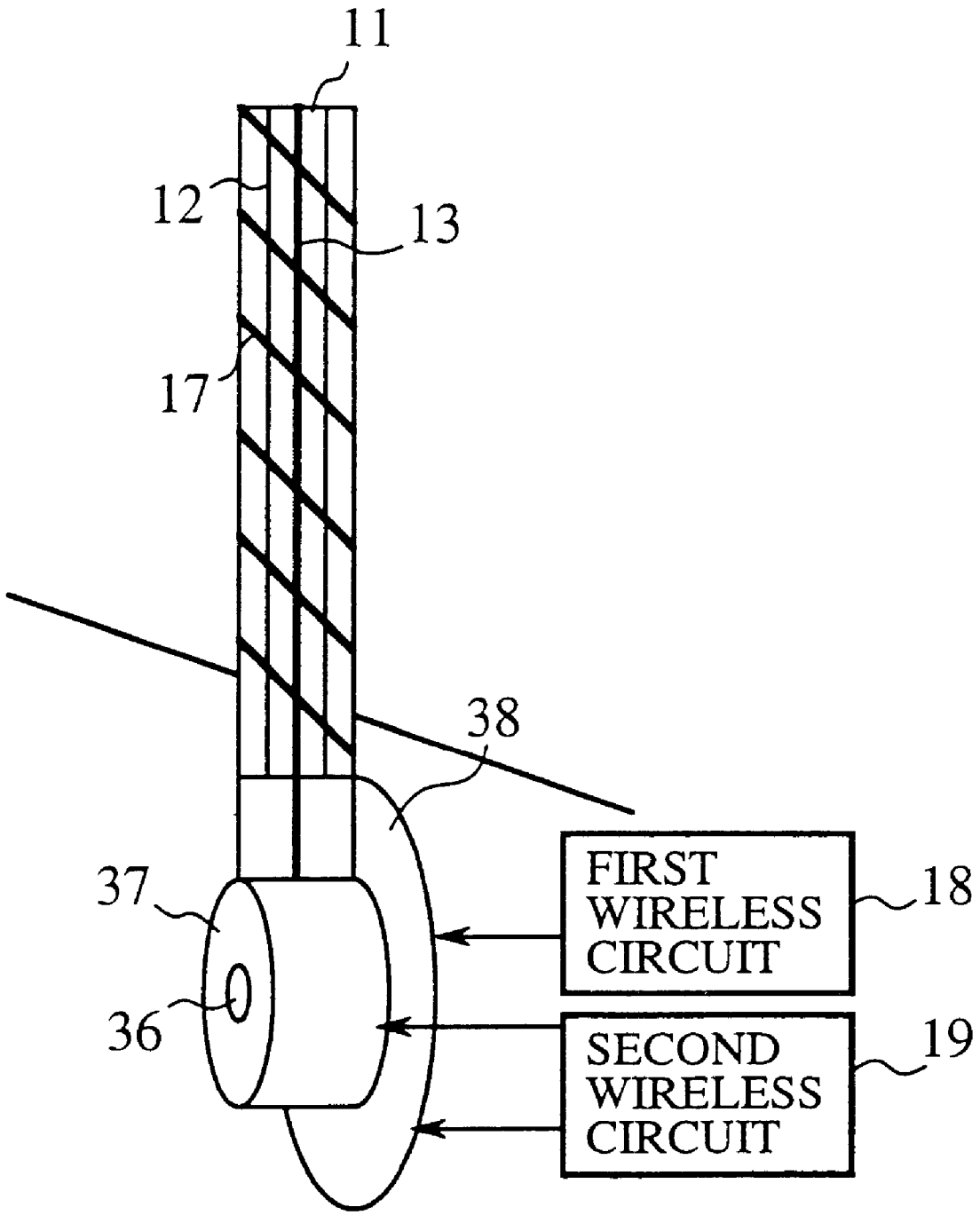
Figure 10:
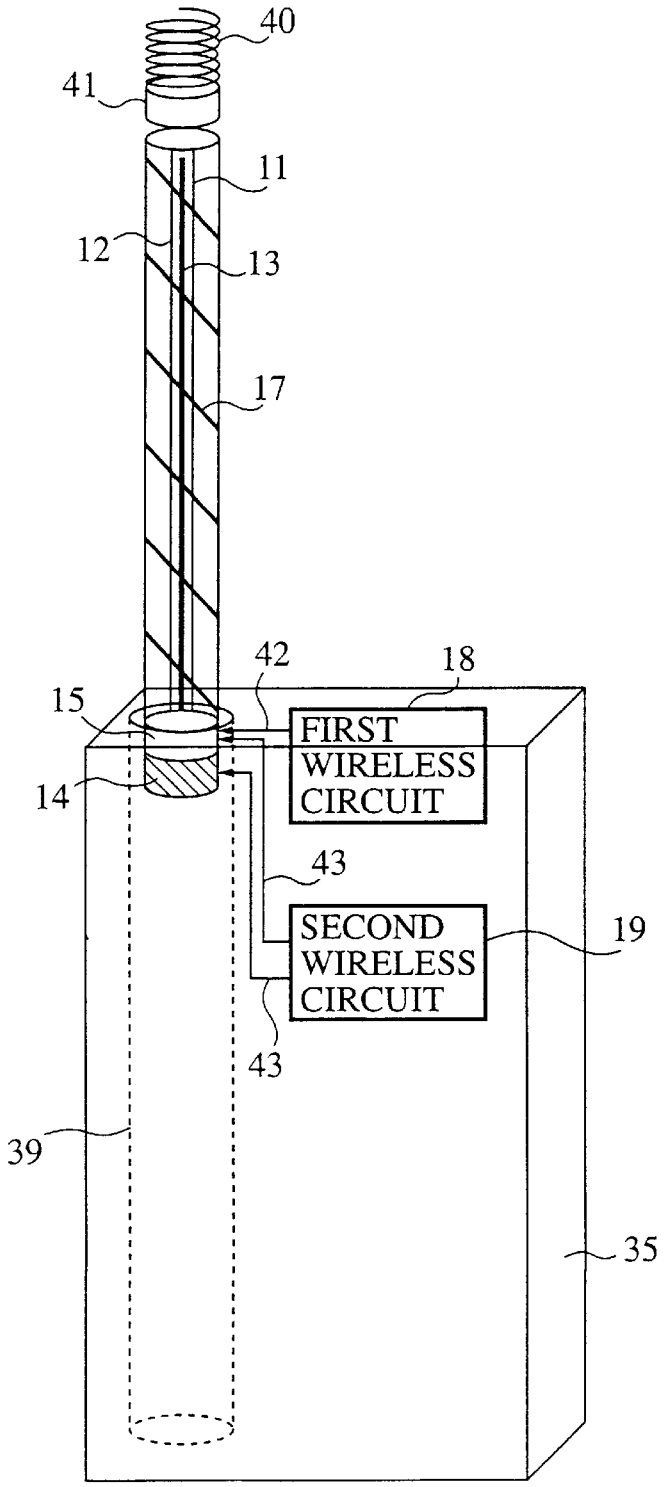
Figure 11:
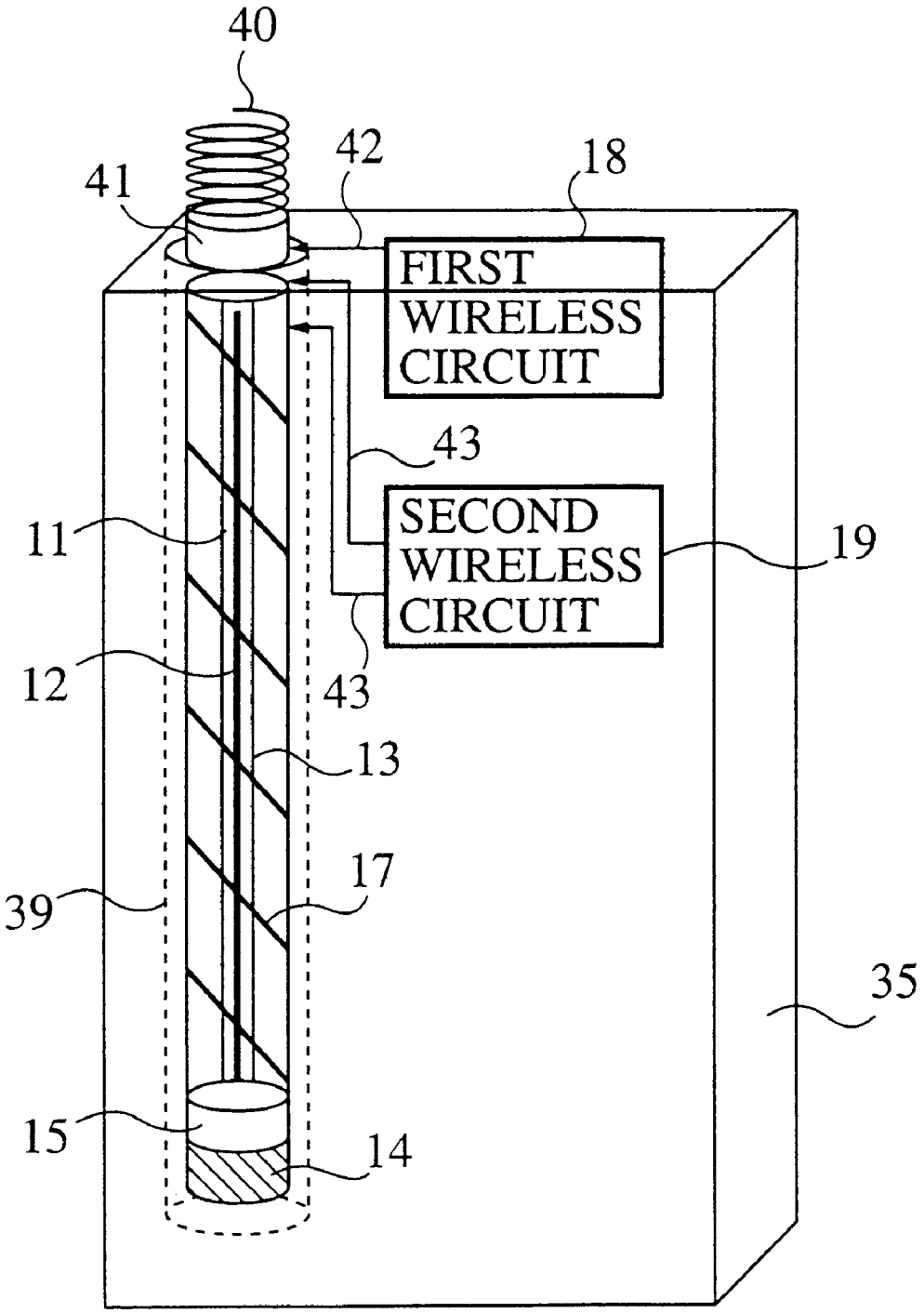
Figure 12:
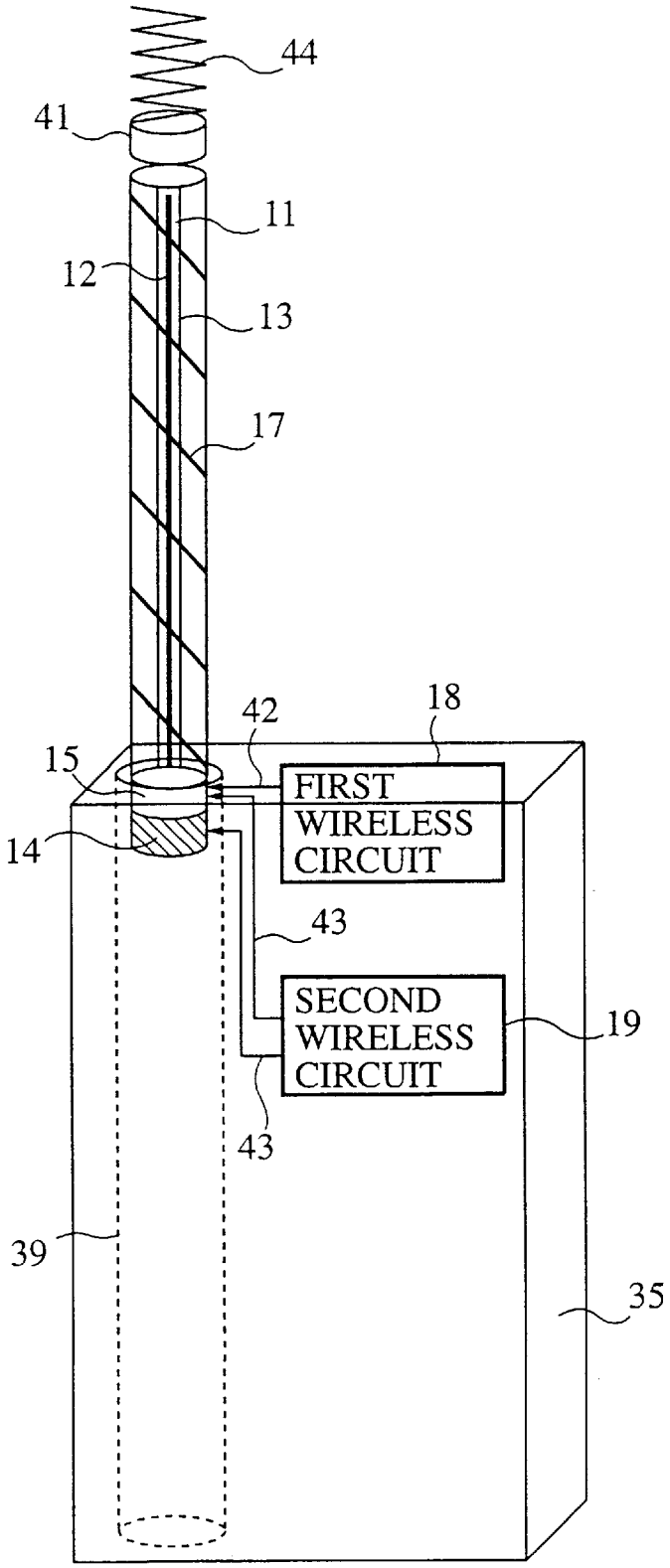
Figure 13:
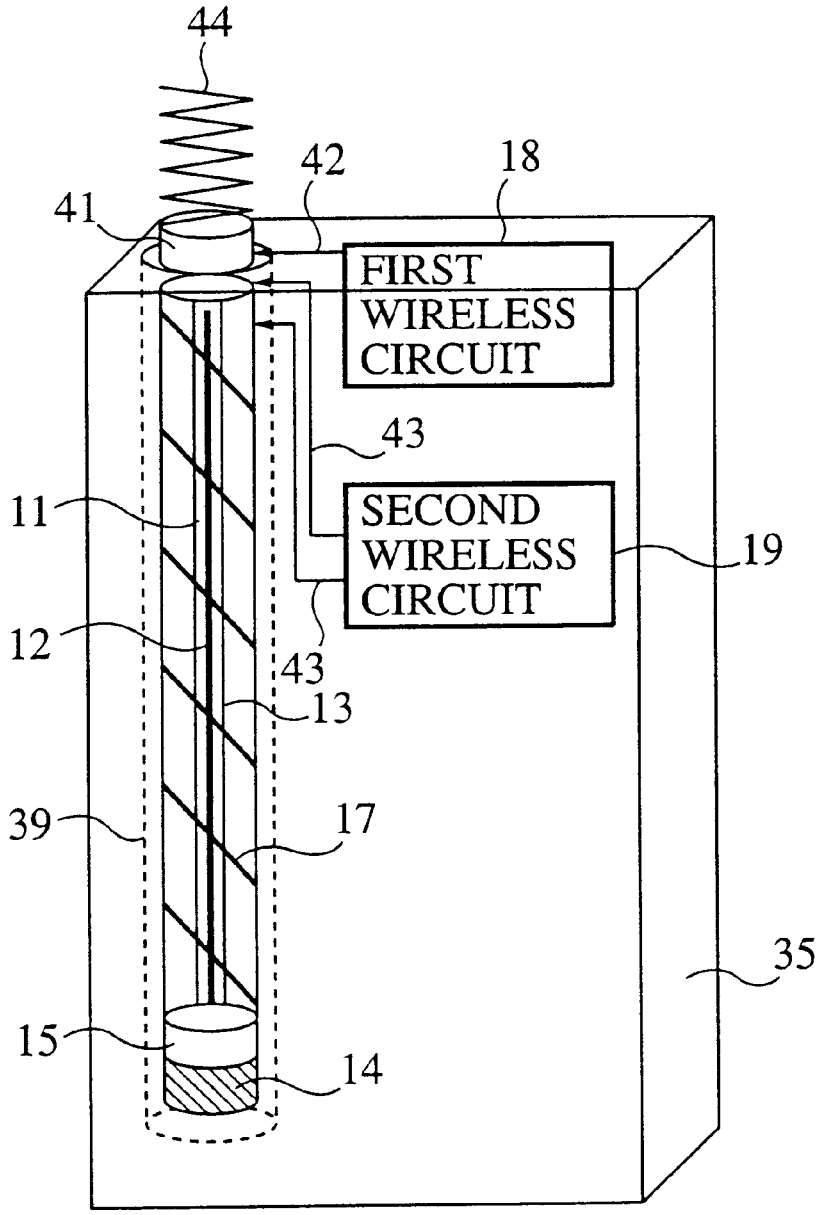

Diagram 7 is a frontal view of the schematic structure of a composite antenna according to the third embodiment of the invention. The diagram shows in schematic form, a composite antenna for use with a portable terminal constructed by the combination, on a single axis, of a two four-wire wound helical antennas constructed from two pairs of helical elements and a single monopole antenna created by two coiled lines of the outer conductor in the coaxial line. The relevant parts of the diagram have the same reference numerals as in FIG. 5.

In the diagram, 23 is the first of the two coaxial lines mentioned above and is coilingly disposed in electrical connection with the outer connector 13. 24 is the second of the aforementioned pair of coaxial lines. 25 a first inner conductor connecting terminal connected to the inner conductor 12 at one end of the first coaxial line 23, 26 is a second inner conductor connecting terminal connected to the inner conductor 12 at one end of the second coaxial line 24, 27 is an outer conductor connecting terminal which is connected to the outer conductor 13 at one end of the first coaxial line 23 and the second coaxial line 24.

28 is a first balun connected to the inner conductor 12 of said first coaxial line 23 at the end opposite to the first outer conductor connecting terminal 27 and the inner conductor connecting terminal 25 of the first coaxial line 23. 29 is a first phase delay element connected to the inner conductor 12 of the first coaxial line 23 through the first balun 28. 30 is a second balun connected to the inner conductor 12 of said second coaxial line 24 at the end opposite to the second outer conductor connecting terminal 27 and the inner conductor connecting terminal 26 of the second coaxial line 24. 31 is a second phase delay element connected to the inner conductor 12 of the second coaxial line 24 through the second balun 30.

32 is a helical element comprised of two pairs of wire conductors constituting the first helical antenna, 33 is a helical element comprised of two pairs of wire conductors constituting the second helical antenna. The end of one pair of helical elements 32 constituting the first helical antenna is connected to the first balun 28, the end of the other pair is connected to the first balun 28 through the first phase delay element 29. In like manner, one end of one pair of the helical elements 33 constituting the second helical antenna is directly connected to the balun 30, the end of the other pair is connected to the second balun 30 through the second phase delay element 31.

The other end of the helical elements 32 and 33 constituting the first and second helical antennas respectively are turned symmetrically around the first and second coaxial lines 23,24 using the coiled first and second coaxial lines 23, 24 as a center so as to face the first and second phase delay elements 29,31 and is then connected to the outer conductor 13 of the first and second coaxial lines 23,24 at the end to which the first inner conductor connecting terminal 25, and the second outer and inner conductor connecting terminals 26,27 of said first and second coaxial lines 23,24 are connected.

34 is a third wireless circuit connected to the inner conductor 12 of the second coaxial line 24 through the second inner conductor connecting terminal 26 and to the outer conductor 13 of the first and second coaxial lines 23, 24 through the outer conductor connecting terminal 27. The first wireless circuit 18 is connected to the outer conductor 13 of the first and second coaxial lines 23,24 through the outer conductor connecting terminal 27. The second wireless circuit 19 is connected respectively to the inner conductor 12 of the first coaxial line 23 through the first outer conductor connecting terminal 25 and to the outer conductor 13 of the first and second coaxial lines 23,24 through the outer conductor connecting terminal 27. The second wireless circuit 19 and the third wireless circuit 34 communicate on different frequency bands and, as shown in the diagram, the frequency band of the second wireless circuit is slightly higher than that of the third wireless circuit 34.

In such a way, a four-wire wound first helical antenna created by the helical element 32 and fed by the first coaxial line and a four-wire wound second helical antenna fed by the second coaxial line 24 by the helical element 33 are formed as is a monopole antenna formed by using the outer conductor of the coiled first and second coaxial lines 23,24 as an antenna element.

The operation of the invention will now be explained.

The first helical antenna formed by the helical element 32 is fed by the first coaxial line 23 and, in a fashion similar to the four-wire wound antenna of the second embodiment, generates a conical beam at a corresponding frequency band. In the same way, the second helical antenna formed by the helical element 33 is fed by the second coaxial line 24 and generates a conical beam at a corresponding frequency band. In this way, the composite antenna apparatus of the third embodiment is characterized by two shared frequencies generating a conical beam at respective frequency bands. Since each of the first and second helical antennas have a four-wire wound structure, there is an improvement in the symmetry of the emission pattern.

Since the outer conductor 13 of the first and second coaxial lines 23,24 to which the first wireless circuit 18 is attached through the outer conductor connecting terminal 27 are mutually contacting and electrically connected, a monopole antenna element is created which functions as a non-directional antenna in the horizontal plane in a way similar to the first and second embodiments.

In the third embodiment, the helical elements 32,33 of the first and second helical antennas are turned symmetrically around the first and second coaxial lines 23, 24. A monopole antenna is created by the outer conductors 13 of the first and second coaxial lines 23,24, which are coiled so as to be electrically connecting, and which acts as an antenna element. Therefore the antenna structure displays line symmetry with respect to the coaxial line, the axes of the emission pattern correspond to each other and respective non-directional antennas in the horizontal plane are created.

Furthermore, since the conductor length or helical pitch of the monopole antenna can be independently created without changing the shape of the helical elements 32,33, no change is observed in the shape of the emission pattern generated by the first and second helical antennas.

As shown above, according to the third embodiment, since a composite antenna apparatus is formed from the combination, on a single axis, of a first four-wire wound helical antenna fed by the first coaxial line 23, created by the helical element 32 and a second four-wire wound helical antenna fed by the second coaxial line 24, created by the helical element 33, together with a monopole antenna formed by the outer conductors 13 running through the center of the first and second coaxial lines and acting as an antenna element. Therefore it is possible to construct, on the same axis, an antenna corresponding respectively to three different kinds of services. As a result, it is possible to achieve more equivalent gain in the horizontal plane and also reduce occupied volume.

Although the above explanation centered on the use respectively of two four-wire wound helical antennas, it is possible to create a composite antenna apparatus using three or more helical antennas. Furthermore the helical antennas are not limited to the four-wire wound type, two-wire wound helical antennas may also be used.

Embodiment 4

Diagram 8 is a perspective diagram showing the schematic structure of the portable terminal used with the composite antenna apparatus according to embodiment 4. Diagram 9 is a perspective diagram showing the schematic structure of the movable fitting of the antenna apparatus. In diagrams 8 and 9, the relevant elements have the same reference numerals as in diagram 1.

In the diagrams, 35 is the wireless body containing the first and second wireless circuits 18,19 to which the composite antenna apparatus. The composite antenna is in turn connected the composite antenna device which is connected rotatably to the wireless body. 36 is the axis of rotation for rotatably connecting the composite antenna to the wireless body 35. The direction of its axis is orthogonal to that of the coaxial line 11 of the composite antenna. 37 is a first slide-action contactor which rotates around the axis of rotation 36. 38 is a second slide-action contactor which is electrically insulated from the first slide-action contactor 37 and rotates around the axis of rotation 36. The first slide-action contactor 37 is electrically connected to the inner conductor 12 of the coaxial line 11 and functions as an inner conductor connecting terminal. The second slide-action contactor is electrically connected to the outer conductor 13 of the coaxial line 11 and functions as an outer conductor connecting terminal.

The operation of the invention will now be explained.

The principle of the operation of the composite antenna is the same as that of embodiments 1 to 3. When fed by the second wireless circuit 19 through the coaxial line 11, the antenna operates as a helical antenna generating a conical beam, when fed by the first wireless circuit 18, the outer conductor 13 of the coaxial line 11 which feeds the helical antenna acts as a monopole antenna.

The first wireless circuit 18 is usually connected to the outer conductor 13 of the coaxial circuit 11 through the second slide-action connector 38 which functions as an outer conductor connecting terminal.

Furthermore, the second wireless circuit 19 is usually connected between the inner conductor 12 of the coaxial line 11 through the first slide-action connector 37 which functions as a inner conductor connecting terminal and the outer conductor 13 of the coaxial line 11 through the second slide-action connector 38. In other words, even if the antenna apparatus comprising the helical antenna fed by the coaxial line 11 and the monopole antenna based on the outer conductor 13 of the coaxial line 11 is rotated using the axis of rotation 36, no difference in the connection of the first and second wireless circuits 18,19 with the inner and outer connectors 11,12 of the coaxial line 11 will result due to the action of the first and second slide-action connectors 37,38.

Therefore when the portable terminal is not in use, the composite antenna apparatus may be fixed in the stacked position in the wireless body 35. When in use, if the composite antenna apparatus is rotated and fixed in the unstacked position out of the wireless body 35 as shown in diagram 8, equivalent gain in the horizontal plane may be obtained.

In such a way, according to embodiment 4, it is possible to create a freely rotating antenna apparatus using the axis of rotation 36 as a center, and since the antenna apparatus may be fixed in the stacked position in the wireless body when not in use, the portability of the portable terminal is improved.

Embodiment 5

As was explained in embodiment 4, the portability of the portable terminal may be improved by rotating and fixing the composite antenna in the stacked position in the wireless body. However portability of the terminal may also be improved by storing the composite antenna inside the wireless body Diagrams 10 and 11 are schematic block diagrams showing the composite antenna according to embodiment 5 of the present invention. Diagrams 10 and 11 show respectively schematic representations of the composite antenna apparatus as extended from the wireless body and as stored in the wireless body. The relevant components of diagrams 10 and 11 have equivalent reference numerals to those in diagrams 8 and 9.

In the diagrams, 39 is the antenna storage unit connected to the first and second wireless circuits 18,19 built into the wireless body and which stores the composite antenna apparatus comprised of a helical antenna fed by a coaxial line 11 and a monopole antenna based on the outer conductor 13 of the coaxial line 11. 40 is a sub-antenna element arranged in series at the top part of the composite antenna apparatus stored in the antenna storage unit 39 so as not to be electrically connected to the coaxial line 11. 41 is the connecting terminal of the sub-antenna element 40. In the fifth embodiment, a helical conductor wound helically on the wire conductor connected to the connecting terminal 41 is used as a sub-antenna 40. 42 is a first spring contact connecting the connecting terminal 41 of the sub-antenna element 40 with the first wireless circuit 19 when the composite antenna apparatus is stored in the antenna storage unit 39 of the wireless body 35 and connected to the outer conductor connecting terminal 15 provided at the lower end of the coaxial line 11 as a switching means when the antenna is extended from the antenna storage unit 39. 43 is a second spring contact functioning as a switching means and connecting a second wireless circuit between the outer conductor connecting terminal 15 and inner conductor connecting terminal 14 provided at the lower end of the coaxial line 11 only when the antenna is extended from the antenna storage unit 39.

The operation of the invention will now be explained.

The operating principle of the composite antenna apparatus is the same as that of embodiments one to three. When fed by the second wireless circuit 19 through the coaxial line 11, the antenna operates as a helical antenna generating a conical beam. When fed by the first wireless circuit 18, the outer conductor 13 of the coaxial line 11 which feds the helical antenna acts as a monopole antenna element.

When the portable terminal is not in use, as shown in diagram 11, the composite antenna apparatus may be stored in the antenna storage unit 39 of the wireless body 35. When in use, as shown in diagram 10, the composite antenna apparatus may be extended from the antenna storage unit 39 of the wireless body 35. As shown in diagram 10, when the composite antenna apparatus in use is extended from the antenna storage unit 39, the first wireless circuit 18 is connected through the first spring connection 42 to the outer conductor connecting terminal 15 disposed at the lower end of the coaxial line 11. The second wireless circuit 19 is connected between the outer conductor connecting terminal 15 and the inner conductor connecting terminal 14 placed at the lower end of the coaxial line 11 through the second spring connection 43. A non-directional antenna in the horizontal plane is created because this helical antenna fed through the coaxial line 11 generates a conical beam and the outer conductor 13 of the coaxial line 11 acts as a monopole antenna element.

When use of the portable terminal is completed, as shown in diagram 11, the composite antenna apparatus may be stored in the antenna storage unit 39 of the wireless body 35. In such a way, the first wireless circuit 18 is connected, through the first spring connection 42, to the connecting terminal 41 of the sub-antenna element 40 created by the helical conductor, the connecting terminal being arranged in series and electrically insulated from the upper part of the coaxial line 11. The second spring connection 43 in the second wireless circuit 19 becomes disconnected as the contact between the inner conductor connecting terminal 15 and the outer conductor connecting terminal 14 in the lower part of the coaxial line 11 becomes disrupted. At such times, the gain of the composite antenna apparatus when in the stored position is ensured by feeding the sub-antenna created by the helical conductor by the first wireless circuit 18 and by using said helical conductor as a helical monopole antenna.

In this way, the invention according to embodiment 5 provides spring shaped connections 42, 43 as switching means. The composite antenna formed by the combination of a helical antenna fed by the coaxial line 11 and the monopole antenna created by the outer conductor 13 of the coaxial line 11 acting as an antenna element is movable in the axial direction and can be stored in the antenna storage unit 39 provided in the wireless body. Therefore when the composite antenna is in the stored position, the portability of the portable unit is improved and gain can be ensured by feeding the sub-antenna element created by the helical conductor and operating it as a helical monopole antenna.

Embodiment 6

As explained above in embodiment 5, the helical conductor may be used as a sub-antenna element. However the sub-antenna element is however not limited to such embodiments.

Diagrams 12 and 13 are schematic block diagrams showing a composite antenna according to embodiment 6 of the present invention, which uses a bent conductor as a sub-antenna element. Diagrams 12 and 13 schematically show the composite antenna respectively as extended from and stored in the wireless body. The relevant components have the same reference numerals as in diagrams 10 and 11. In the diagrams, 44 is a sub-antenna element comprised by the conductor formed from a zigzag shaped wire conductor and is disposed in series at the top of the composite antenna apparatus stored in the antenna storage unit 39 so as not to be in electrical contact with the coaxial line 11.

The operation of the invention will now be explained.

The principle of operation of the composite antenna apparatus constituted in such a manner is basically the same as embodiment 5 above. When extended from the antenna storage unit 39, the antenna operates by a helical antenna fed by the coaxial line 11 and monopole antenna created by the outer conductor 13 of the coaxial line 11. Even when stored in the antenna storage unit 39, gain is ensured by the sub-antenna element 44 created by the folded conductor being fed by the first wireless circuit 18.

Thus according to embodiment 6 the portability of the portable terminal is improved and gain is ensured when the antenna is in the stored position.

Industrial Applicability

As shown above, the composite antenna apparatus of the present invention is a combination, on the same axis, of a helical antenna fed by the coaxial line 11 and a monopole antenna created by the outer conductor which runs through the center of the coaxial line acting as an antenna element. As a result, since equivalent gain is achieved in the horizontal plane as well as a reduction in occupied volume, the wireless antenna device may be used to receive a plurality of mobile communication services on different wave bands. Furthermore since improved portability due to the movability of the said antenna device allows for its storage in the wireless body when not in use, the device is adapted for use as an antenna device for a portable terminal.

What is claimed is:

1. A composite antenna device comprising a coaxial line, a balun connected to an inner conductor at one end of said coaxial line, a helical element formed from a pair of wire conductors, one end of said helical element being connected to said balun, the other end of said helical element being aligned facing said balun by winding it symmetrically around the coaxial line using the coaxial line as a center and being connected to an outer conductor at the other end of said coaxial line, an inner conductor connecting terminal connected to the inner conductor at the other end of the said coaxial line and an outer conductor connecting terminal connected to the outer conductor at the other end of the said coaxial line.

2. The composite antenna device according to claim 1 wherein one end of the helical element formed by the pair of wire conductors is attached to the balun provided at one end of the coaxial line , its other end is aligned facing said balun by winding it symmetrically around said coaxial line using said coaxial line as a center and is attached to the outer conductor at the other end of said coaxial line, a first wireless circuit is connected to the outer conductor connecting terminal and a second wireless circuit is connected between said outer conductor connecting terminal and inner conductor connecting terminal provided at the other end of said coaxial line.

3. The composite antenna device according to claim 1 wherein a phase delay element is provided at that end of the coaxial line which is provided with the balun, an end of the first helical element formed from the pair of wire conductors is connected directly to the balun, an end of a second helical element formed from the pair of wire conductors is connected to said balun through said phase delay element, the other ends of said first and second helical elements are aligned facing said balun and said phase delay element by winding the ends symmetrically around said coaxial line using said coaxial line as a center and are connected to the outer conductor at the other end of said coaxial line, a first wireless circuit is connected to the outer conductor connecting terminal and a second wireless circuit is connected between said outer conductor connecting terminal and inner conductor connecting terminal provided at the other end of said coaxial line.

4. The composite antenna device of claim 1 wherein one end of a plurality of helical elements formed from pairs of wire conductors is respectively connected to each of a plurality of baluns provided respectively at one end of a plurality of bundled coaxial lines in which the outer conductors are mutually contacting, the other end of each helical element is aligned facing said baluns by being wound symmetrically around said coaxial lines using said coaxial lines as a center and is connected to the outer conductors at the other end of said coaxial lines, said composite antenna providing a plurality of inner conductor connecting terminals connected to the respective inner conductors and a plurality of outer conductor connecting terminals connected to the respective outer conductors at the other end of each said coaxial line.

5. The composite antenna apparatus of claim 4 which provides a first phase delay element at the end to which a first balun of a first coaxial line is attached and a second phase delay element at the end to which a second balun of a second coaxial line is attached, an end of one pair of the two pairs of helical elements constituting a first helical antenna is connected to said first balun through said first phase delay element, the other end is connected to said first balun directly, an end of one pair of the two pairs of helical elements constituting a second helical antenna is connected to said second balun through said second phase delay element, the other end is connected to said second balun directly, the other end of each said helical element is aligned symmetrically facing said balun and phase delay element by winding the end symmetrically around each said coaxial line using the line as a center and is connected to the outer conductor at the other end of each said coaxial line, the first wireless circuit is connected to the outer conductor connecting terminal connected to the outer conductor at the other end of said first and second coaxial lines, the second wireless circuit is connected between said outer conductor connecting terminal and said first inner conductor connecting terminal connected to the inner conductor at the other end of said first coaxial line, the third wireless circuit is connected between said outer conductor connecting terminal and the second outer conductor connecting terminal which is connected to the outer conductor at the other end of said second coaxial line.

6. The composite antenna apparatus according to claim 1 wherein a plurality of mutually insulated slidable connectors rotatable around an axis of rotation orthogonal to the directional axis of the coaxial line are disposed at the end of the coaxial line facing the balun, each said slidable connector is connected to either the outer conductor or inner conductor of said coaxial line, slidable connectors connected to the inner conductors of said coaxial lines act as an inner conductor connecting terminal, slidable connectors connected to the outer conductors act as an outer conductor connecting terminal.

7. The composite antenna apparatus according to claim 1 wherein the balun is provided at the top end of the coaxial line extendable or storable in the wireless body, an end of the helical element is connected to said balun, the other end is aligned facing said balun by winding the end symmetrically around said coaxial line and is connected to the outer conductor at the lower part of said coaxial line, a sub-antenna element having a connecting terminal is disposed in series being electrically insulated from said coaxial line at the top part of said coaxial line, when said coaxial line is in the stored position, a single wireless circuit is connected to the connecting terminal of said sub-antenna element, when in the extended position, a wireless circuit, connected to the connecting terminal of said sub-antenna element when said coaxial line is stored, is connected to the outer conductor connecting terminal provided at the lower part of said coaxial line, another wireless circuit is connected between the inner conductor connecting terminal provided at the lower end of said coaxial line and the outer conductor connecting terminal, said wireless circuits being switching means.

8. The composite antenna apparatus according to claim 7 wherein the sub-antenna element is comprised by a helical conductor formed by helically winding a wire conductor connected to a connecting terminal.

9. The composite antenna apparatus according to claim 7 wherein the sub-antenna element is comprised by a bent conductor formed by winding, in a zigzag pattern, a wire conductor connected to a connecting terminal.

* * * * *